United States Patent [19]

Ishii

[11] Patent Number: 4,976,015

[45] Date of Patent: Dec. 11, 1990

[54] SLIDER PULL TAB FOR SLIDE FASTENER

[75] Inventor: Susumu Ishii, Kurobe, Japan

[73] Assignee: Yoshida Kogyo K. K., Tokyo, Japan

[21] Appl. No.: 429,610

[22] Filed: Oct. 31, 1989

[30] Foreign Application Priority Data

Nov. 15, 1988 [JP] Japan ..... 63-148914[U]

[51] Int. Cl.[5] ..... A44B 19/26

[52] U.S. Cl. ..... 24/429; 24/419; 24/431

[58] Field of Search ..... 24/429, 419, 425, 430, 24/431

[56] References Cited

U.S. PATENT DOCUMENTS

| | | | |
|---|---|---|---|
| 2,019,220 | 10/1935 | Gammons | 24/431 |
| 2,145,118 | 1/1939 | Knoess | 24/431 |
| 2,495,176 | 1/1950 | Nissen | 24/429 |
| 3,583,044 | 6/1971 | Howell | 24/431 |
| 4,512,064 | 4/1985 | Nishikawa | 24/429 |
| 4,790,050 | 12/1988 | Ishii | 24/419 |

FOREIGN PATENT DOCUMENTS

| | | | |
|---|---|---|---|
| 0896213 | 3/1972 | Canada | 24/429 |

*Primary Examiner*—Victor N. Sakran

*Attorney, Agent, or Firm*—Hill, Van Santen, Steadman & Simpson

[57] ABSTRACT

A slider pull tab for slide fastener is disclosed, which comprises a connector means, a decorative portion integral therewith and exposed to view at least one surface of the connector means and a grip web formed from soft-type rubber or plastics material. The connector means has a through opening and/or a through aperture which are filled by the material of the grip web during formation of the latter thereby providing increased tensile strength against pull stresses exerted upon pulling the slider pull tab.

6 Claims, 3 Drawing Sheets

SLIDER PULL TAB FOR SLIDE FASTENER

BACKGROUND OF THE INVENTION

1. Field of the Invention

This invention relates to sliders for slide fasteners and more particularly to a slider pull tab made from the combination of a rigid portion and a flexible portion.

2. Prior Art

There are known a variety of slide fastener sliders having associated therewith different forms and designs of pull tab which are tailored to meet the particular specifications set up by the garment manufacturers who produce all sorts of garment articles ranging from clothing, sports wear, sports equipment to bags, etc.

A growing demand has recently been voiced for more aethetically attractive slider pull tabs which are formed predominantly of an elastic, flexible material such as synthetic rubber, synthetic leather or other synthetic resinous materials.

A slider pull tab made of such elastic material is exemplified in for instance Japanese Laid-Open Utility Model Publication No. 62-102407, which pull tab feels soft and can be gripped flexibly and non-slipplingly. However, since the body of this pull tab is formed uniformly and solely from an artificial soft rubber or resin, its appearance lacks ornamental appeal. The prior art pull tab (as shown in FIG. 10) is further vulnerable to a pull force because it is connected to the slider body through a connector which is merely embedded in part within the material of the pull tab.

SUMMARY OF THE INVENTION

With the foregoing drawback of the prior art in view, the present invention seeks to provide an improved slider pull tab of a flexible structure which is both ornamentally attractive and abundant in tensile strength.

According to the invention, there is provided a slider pull tab for slide fastener which comprises a connector means, a decorative portion integral therewith and exposed to view at least on one surface of said connector means, and a grip web formed from an elastic soft-type resinous material, the connector means having a through opening or aperture which is filled by the resinous material of the grip web.

The invention will be further described with reference to the drawings, in which like reference numerals refer to like or corresponding parts.

DETAILED DESCRIPTION

Figure 1:
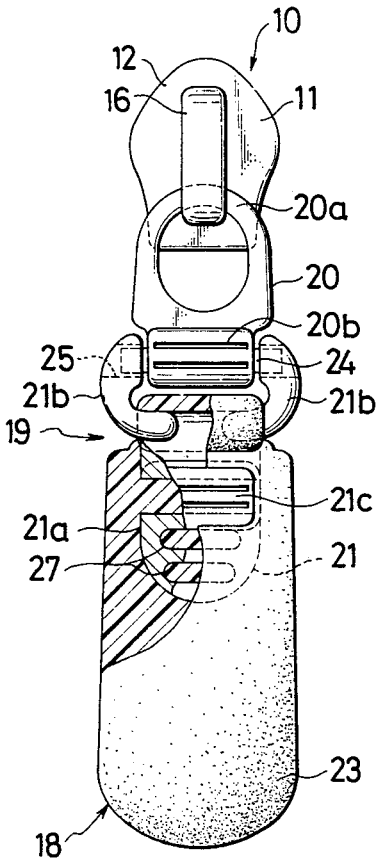
FIG. 1 is a partly sectional plan view of a slider pull tab embodying the invention shown connected to a slider body.

Referring now to the drawings and FIG. 1 in particular, there is shown a slider 10 including a pull tab embodying the invention, the slider 10 reciprocally movable to open and close a slide fastener (not shown) in a well known manner. The slider 10 comprises a slider body 11 formed by an upper flange 12 and a lower flange 13 defining therebetween a guide channel 14 for the passage of coupling element rows of the slide fastener and connected together at one end by a neck 15, and an arch-shaped trunnion 16 having an aperture 17 for pivotally receiving a pull tab 18.

The pull tab 18 shown in FIGS. 1–4 inclusive has a connector means 19 including a first connector 20 and a second connector 21 pivotally connected thereto and a grip web 23 extending over the second connector 21.

The first connector 20 has at one of its ends a ring-like hook portion **20*a* pivotally received in the aperture 17 of the trunnion 16 and at the opposite end a first decorative portion 20*b* having an integral pivotal pin 24 projecting transversely of the pull tab 18** at each of its opposite ends.

Figure 3:
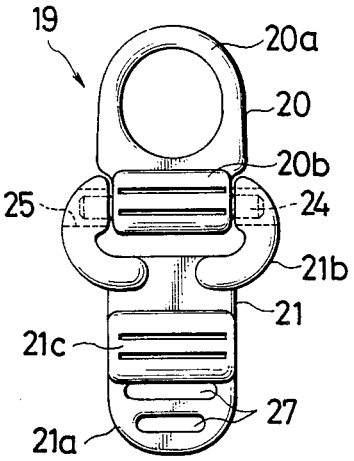
FIG. 3 is a plan view of a connector assembly forming part of the pull tab of FIG. 1.

The second connector 21 of the connector assembly 15 better shown in FIG. 3 consists of a tongue-like portion **21*a*, the majority of which is adapted to be embedded in or enveloped by a plastics material forming the grip web 23, and a pair of arcuately shaped arms 21*b* each having one end formed integrally with the upper end portion of the tongue-like portion 21*a* and at the other end a transverse bore 25 pivotally engaged with the respective pin 24 so that the second connector 21 can rotate relative to the first connector 20**.

Figure 2:
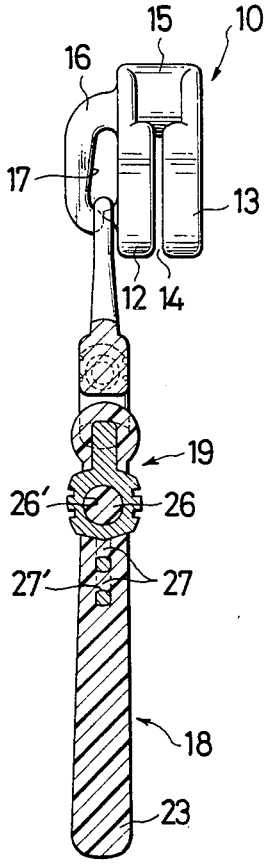
FIG. 2 is a longitudinal cross-sectional view of the pull tab in FIG. 1.
Figure 4:
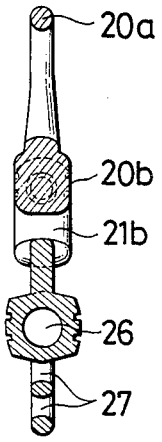
FIG. 4 is a longitudinal cross-sectional view of the same.
Figure 5:
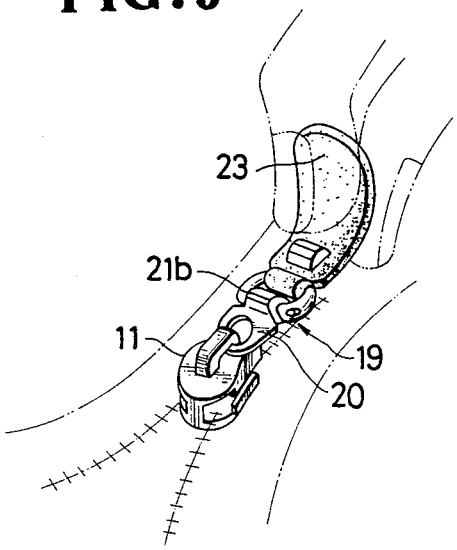
FIG. 5 is a diagrammatic perspective view of the pull tab of FIG. 1 being manipulated.

The second connector 21 further includes a second decorative portion **21*c* projecting from and above opposite surfaces of the tongue-like portion 21*b* as better shown cross-sectionally in FIGS. 2 and 4. There is a through opening 26 formed in and extending transversely clear through the second decorative portion 21*c*. A plurality of elongate apertures 27 are also provided extending clear through the thickness of the tongue-like portion 21*b*, one of which borders with the second decorative portion 21*c***.

The grip web 23 is formed by injection-molding of a suitable elastic, soft synthetic resin such as synthetic rubber, soft-type polyvinyl chloride, polyurethane and the like. During this injection-molding, the resinous material flows into and fills up the opening 26 as well as the apertures 27, resulting in the formation of two directional connecting bridges 26' and 27' oriented in the direction of width and thickness respectively of the pull tab 18. The connecting bridges 26' and 27' serve to prevent the grip web 23 from separating from the second connector 21 and also provide increased tensile strength against pulling force exerted when manipulating the slider 10 to open or close the slide fastener by means of the pull tab 18.

Both first and second connectors 20 and 21 are formed from a metallic material but may be likewise formed from mechanically strong plastics material.

The decorative portions **20*b* and 21*c* of the first and second connectors 20 and 21** respectively may present any ornamentally attractive designs on their exposed surfaces or may be attached with trademarks or planted with jewelries to provide aesthetic appeal for such slide fastener parts as sliders which have thus far been regarded more functionally than ornamentally.

Various modifications of the pull tab structure embodying the invention made be made as exemplified in FIGS. 6 through 9 inclusive.

Figure 6:
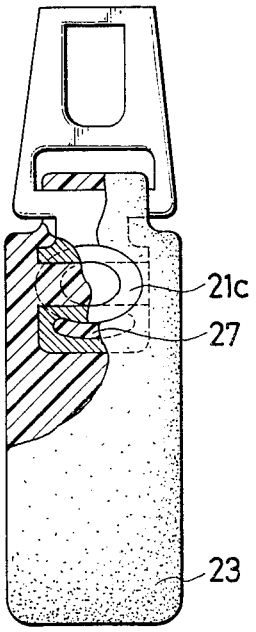
FIG. 6 is a sectional plan view of a modified form of pull according to the invention.

The pull tab 18 illustrated in FIG. 6 features combining the first and second connectors 20, 21 into a one-piece structure devoid of the coupling means of pin 24 and bore 25. The decorative portion 21*c* of the second connector 21 carries an oval design exposed to view. The aperture 27 is arcuately shaped to extend along and in registry with the lower portion of the decorative portion 21*c*.

Figure 7:
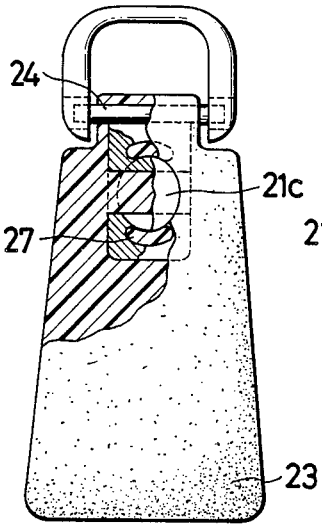
FIG. 7 is a partly sectional plan view of another modified form of pull tab.
Figure 8:
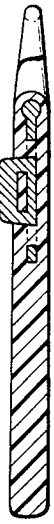
FIG. 8 is a longitudinal cross-sectional view of the same.

The pull tab 18 shown in FIGS. 7 and 8 differs from the embodiment shown in FIG. 1–4 in that the pins 24 are formed integral with the second connector 21 and engaged in the bores 25 formed in the first connector 20 to allow pivotal movement of the latter, and in that the decorative portion 21*c* carries a vertically oriented oval design exposed to view only on one surface of the grip web 23 and in that a pair of arcuate apertures 27 are located respectively in close proximity with the upper and lower peripheral portions of the oval design.

Figure 9:
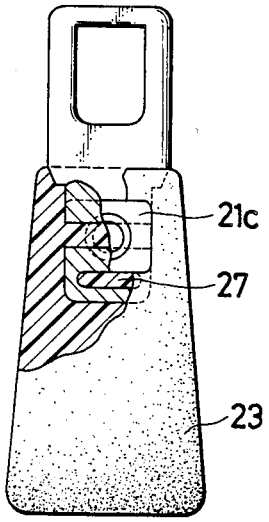
FIG. 9 is a partly sectional plan view of still another modified form of pull tab.
Figure 10:
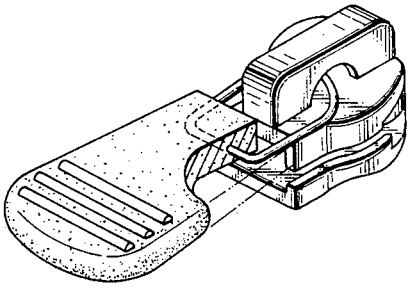
FIG. 10 PRIOR ART
FIG. 10 is a perspective view of a prior art slider pull tab.

FIG. 9 shows a one-piece structure of first and second connectors 20, 21 which is similar to that of FIG. 6 but which is characterized by extension of the grip web 23 up to the stem portion of the first connector 20.

Obviously, various modifications and variations of the present invention are possible in the light of the above teaching. It is therefore to be understood that within the scope of the appended claims the invention may be practiced otherwise than as specifically described.

What is claimed is:

1. A slider pull tab for slide fastener which comprises a connector means, a decorative portion integral therewith and exposed to view at least on one surface of said connector means, and a grip web formed from an elastic soft-type resinous material, said connector means having a through opening or aperture which is filled by the resinous material of said grip web, wherein said through-opening or aperture is formed in and extends transversely clear through said decorative portion, and extends clear through the thickness of said connector means.

2. A slider pull tab according to claim 1 wherein said connector means includes a first connector and a second connector which are pivotally connected by a pin.

3. A slider pull tab according to claim 2 wherein said pin is formed on said first connector and engaged in a bore formed in said second connector.

4. A slider pull tab according to claim 2 wherein said pin is formed on said second connector and engaged in a bore formed in said first connector.

5. A slider pull tab according to claim 1, further including an additional decorative portion integral with said connector means.

6. A slider pull tabs according to claim 1 wherein said aperture is located in close proximity to said decorative portion.

* * * * *